US008477565B2

(12) United States Patent
Blondeau et al.

(10) Patent No.: US 8,477,565 B2
(45) Date of Patent: Jul. 2, 2013

(54) ANALOGUE DISPLAY DEVICE INCLUDING A PLANETARY GEAR DEVICE

(75) Inventors: Fabien Blondeau, Chézard-St-Martin (CH); Emmanuel Fleury, Moutier (CH); Pierre-André Meister, Biel (CH); André Zanetta, Wavre (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 799 days.

(21) Appl. No.: 12/088,280

(22) PCT Filed: Oct. 4, 2006

(86) PCT No.: PCT/EP2006/067032

§ 371 (c)(1),
(2), (4) Date: Nov. 9, 2010

(87) PCT Pub. No.: WO2007/048685

PCT Pub. Date: May 3, 2007

(65) Prior Publication Data

US 2011/0051562 A1 Mar. 3, 2011

(51) Int. Cl.
*G04B 19/02* (2006.01)
*G04B 19/04* (2006.01)

(52) U.S. Cl.
USPC ..... 368/80; 368/220; 368/223

(58) Field of Classification Search
USPC ..... 368/77, 80, 220, 221, 223
See application file for complete search history.

(56) References Cited

U.S. PATENT DOCUMENTS

| | | | | |
|---|---|---|---|---|
| 4,428,682 | A | 1/1984 | Winter | |
| 4,659,232 | A * | 4/1987 | Coster et al. | 368/223 |
| 5,103,434 | A * | 4/1992 | Sullivan | 368/238 |
| 5,349,572 | A * | 9/1994 | Belik | 368/77 |
| 5,359,578 | A | 10/1994 | Truini | |
| 5,999,496 | A * | 12/1999 | Chaut | 368/223 |
| 7,630,277 | B2 * | 12/2009 | Conus et al. | 368/220 |

FOREIGN PATENT DOCUMENTS

| | | |
|---|---|---|
| CH | 664 468 A3 | 3/1988 |
| EP | 0 326 655 | 8/1989 |
| EP | 0 813 124 A1 | 12/1997 |

(Continued)

OTHER PUBLICATIONS

International Search Report issued in corresponding application No. PCT/EP2006/067032, completed Apr. 11, 2007 and mailed Apr. 23, 2007.

*Primary Examiner* — Vit W Miska
(74) *Attorney, Agent, or Firm* — Griffin & Szipl, P.C.

(57) ABSTRACT

The invention concerns a timepiece (10) including a display device (26) including a first and second display member (38, 40) displaying first and second pieces of information, the value of the second piece of information being linked to the value of the first piece of information by a reduction ratio, wherein the first (38) and the second (40) display members are rotatably mounted in relation to a plate (42) and are driven by a drive device (44) with planetary gears, characterized in that the second display member (40) pivots on the axis of rotation (A2) of a planet pinion (54). The invention also proposes a timepiece (10) fitted with this display device (26) and a method for manufacturing this display device (26).

27 Claims, 2 Drawing Sheets

FOREIGN PATENT DOCUMENTS

| | | | |
|---|---|---|---|
| EP | 0 851 295 | A1 | 7/1998 |
| JP | 57023881 | | 2/1982 |
| WO | 01/33711 | A1 | 5/2001 |
| WO | 2004/081695 | A2 | 9/2004 |

* cited by examiner

ANALOGUE DISPLAY DEVICE INCLUDING A PLANETARY GEAR DEVICE

This is a National Phase Application in the United States of International Patent Application No. PCT/EP2006/067032 filed Oct. 4, 2006, which claims priority on European Patent Application No. 05023260.2, filed Oct. 25, 2005 The entire disclosures of the above patent applications are hereby incorporated by reference.

FIELD OF THE INVENTION

The invention concerns an analogue display device including a planetary gear drive for the analogue display members. The invention also concerns a timepiece including such a display device, and a method of manufacturing said display device.

BACKGROUND OF THE INVENTION

An analogue display device of this type is fitted to the timepiece that is disclosed in JP Patent No. 5702881. This patent discloses and shows a motion work with planetary gears for driving the minute hand and hour hand. For this purpose, it comprises a drive arbour carrying the minute hand at the top end thereof and a drive pinion at the bottom end thereof, the drive pinion meshing with a drive wheel. The drive arbour is provided with a central pinion that is inserted axially between an hour wheel, which is provides for carrying the hour hand, and the drive pinion. The central pinion meshes with two planet pinions, which mesh with a fixed crown with an inner toothing. The mobile axes of rotation of the planet pinions are extended upwards via posts which are respectively received in complementary housings of the hour wheel, so that the rotation of the planet pinions about the drive arbour causes the hour wheel to rotate clockwise.

Of course, the gear reduction between the central pinion and the planet pinions is chosen to obtain the ratio 1:2 between the number of revolutions completed by the hour hand and the number of revolutions completed by the minute hand.

This type of motion work has the advantage of being very compact axially. However, the method of driving the hands remains conventional, i.e. it relies on an hour wheel that has to be mounted on the drive arbour of the minute hand by indenting. The minute hand is driven onto its drive arbour and the hour hand is driven onto the hour wheel. This type of motion work thus requires relatively complex assembly operations.

CH Patent No. 664 468 discloses and shows a timepiece wherein a day/night indicator disc forms the cage of a differential gear which carries the planet pinions meshed with a planetary wheel secure to the hour wheel.

This timepiece has the same type of drawbacks as those previously mentioned, since the hands and the planetary wheel are still mounted on an hour wheel in a conventional manner, which makes the assembly operations relatively complex. Moreover, the structure disclosed in this patent does not allow the display member carrying the planet pinions to be arranged above the dial because of axial space problems and because of the presence of a complex correction mechanism.

It is thus an object of the present invention to improve the construction of this type of analogue display device by simplifying it.

SUMMARY OF THE INVENTION

The invention therefore concerns a timepiece including a display dial and a display device which includes a first rotating analogue display member displaying a first piece of information and a second rotating analogue display member displaying a second piece of information, the value of the second piece of information being linked to the value of the first piece of information in accordance with a determined reduction ratio, wherein the first and second display members are rotatably mounted in relation to a plate about the same main axis and are driven in rotation by a planetary gear drive device carried by the plate, and wherein the drive device includes a motor element provided for driving in rotation a central pinion, which is secured in rotation to the first display member, and at least one planet pinion which meshes with the central pinion and with a crown with an inner toothing, the second display member being driven in rotation about the main axis by the movement of the planet pinion arbour, characterized in that the second display member extends into a plane located above the display dial, and in that the second display member pivots on the axis of rotation of the planet pinion.

The display device according to the invention has the advantage of being particularly compact, both radially and axially. Moreover, the number of parts necessary for it to operate is particularly reduced. In particular, it should be noted that the second display member plays the part of the planetary wheel carrier in the planetary gear system, since the second display member is directly linked to the planet pinion, which means that one intermediate part is omitted compared to the device known in the prior art.

According to an advantageous feature of the timepiece, the drive device includes a drive arbour, coaxial to the main arbour, which is driven in rotation by the motor element, and the central pinion and the first display member are secured to the central arbour. The drive arbour can be formed by the output arbour of the motor element which offers a simplified structure and assembly.

Preferably, the connection between the second display member and the planet pinion is achieved by a pivot which is carried by the second display member. The structure of this connection is easy to fabricate and easy to assemble. In particular, the pivot can be made in a single piece with the second display member.

According to an advantageous embodiment, the drive device includes three planet pinions and the second display member pivots on the axes of rotation of the three planet pinions, which increases the stability of the second display member and reduces the effect of any operating plays on the driving in rotation thereof.

The second display member is held axially on the opposite side of the plate by the first display member, a spacer element being inserted between the first and second display members, which offers a simple solution for assembling the second display member on the main axis of rotation, which does not require any additional part or any specific shape for the drive arbour.

Preferably, the second display member covers the whole of the circular area delimited by the crown, such that it performs the function of a cover to protect the gear elements from any external particles. In order to hold the second display member axially on the opposite side to the first display member, while minimising friction, the crown includes an annular radial surface provided with a circular slide path on which the second display member rests.

The crown, the central pinion and the planet pinion extend in generally the same radial plane, which makes the device easier to manufacture and minimises its axial space requirement.

Preferably, the crown is made in a single piece with the plate and the plate is carried by the dial, which enables the two parts to be manufactured simultaneously, particularly via micro-machining techniques using lithographic processes. A more rigid drive device that is easier to assemble is thus obtained.

The plate can be added to the display face of the dial, which allows the dial to be altered without altering the display device. The plate can also be made in a single piece with the dial, which minimises the number of parts in the display device and implements micro-machining techniques using lithographic processes, making the dial and the plate in a mono-crystalline material. This type of dial made of mono-crystalline material having semiconductor properties also allows electronic circuit components to be integrated in the dial, for example for controlling the display device, or for integrating a motor element made in the form of an electro-mechanical micro-system etched in the dial.

According to an advantageous embodiment, the drive device includes slide elements which are inserted between one face of the plate and the pinions in order to decrease their resistance to friction during rotation. These slide elements are formed by circular slide paths arranged on the plate and made in a single piece with the plate.

The display members are preferably hands, which enables the display device to be used in numerous applications, in particular clock and watch applications. The first display member is formed by a minute hand and the second display member is formed by an hour hand.

The invention also proposes a method of manufacturing a timepiece comprising a display dial and a display device, a first rotating analogue display member displaying a first piece of information and a second rotating analogue display member displaying a second piece of information, the value of the second piece of information being linked to the value of the first piece of information in accordance with a determined reduction ratio, wherein the first and second display members are rotatably mounted in relation to a plate about the same main axis and are driven in rotation by a planetary gear drive device carried by the plate, and wherein the drive device includes a motor element provided for driving in rotation a central pinion, which is secured in rotation to the first display member, and at least one planet pinion which meshes with the central pinion and with a crown with an inner toothing, the second display member being driven in rotation about the main axis by the movement of the planet pinion arbour, characterized in that it includes an assembly step during which the second display member is freely rotatably mounted onto the main axis and during which the second display member is assembled to the planet pinion by a pivot and in that a micro-machining step including lithographic processing is implemented to obtain the plate and the crown in a single piece.

Owing to the manufacturing method according to the invention, assembly of the display device is simplified, since the number of operations is reduced.

According to advantageous features of this method, the planet pinion can be made during the same micro-machining step. This method allows a large number of display devices to be reliably manufactured in parallel, which limits costs while obtaining high quality components with great precision. Preferably, the plate is made in a single piece with the display device dial during the micro-machining step, which allows manufacture of a dial in which the display device components are already integrated.

BRIEF DESCRIPTION OF THE DRAWINGS

Other features and advantages of the present invention will appear more clearly upon reading the following detailed description, made with reference to the annexed drawings, given by way of non-limiting example and in which.

DETAILED DESCRIPTION OF THE ILLUSTRATIVE EMBODIMENTS

In the following description, identical or similar elements will be designated by the same references.

Figure 1:
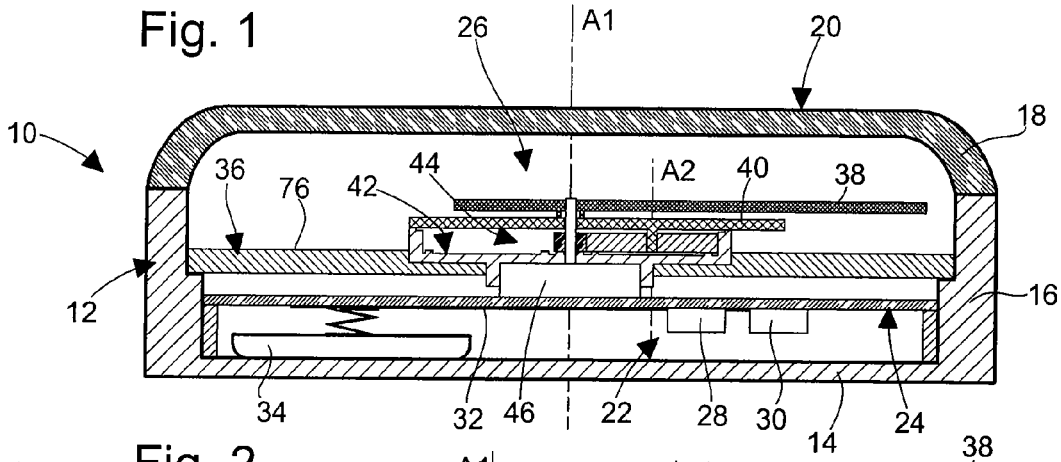
FIG. 1 is an axial cross-section which schematically shows a watch fitted with a display device according to a first embodiment in accordance with the teaching of the invention.
Figure 2:
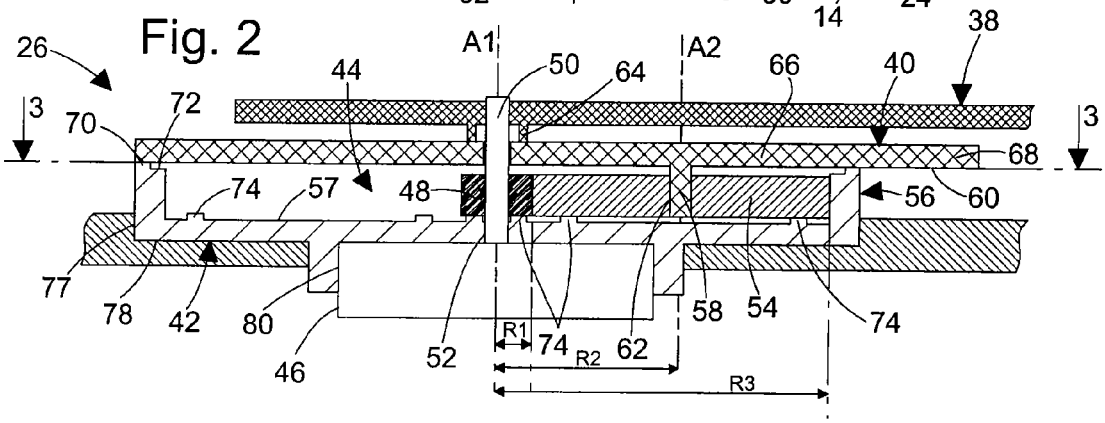
FIG. 2 is an axial cross-sectional detail along the cross-sectional plane 2-2 which shows an enlarged view of the display device and the drive device fitted to the watch of FIG. 1.
Figure 3:
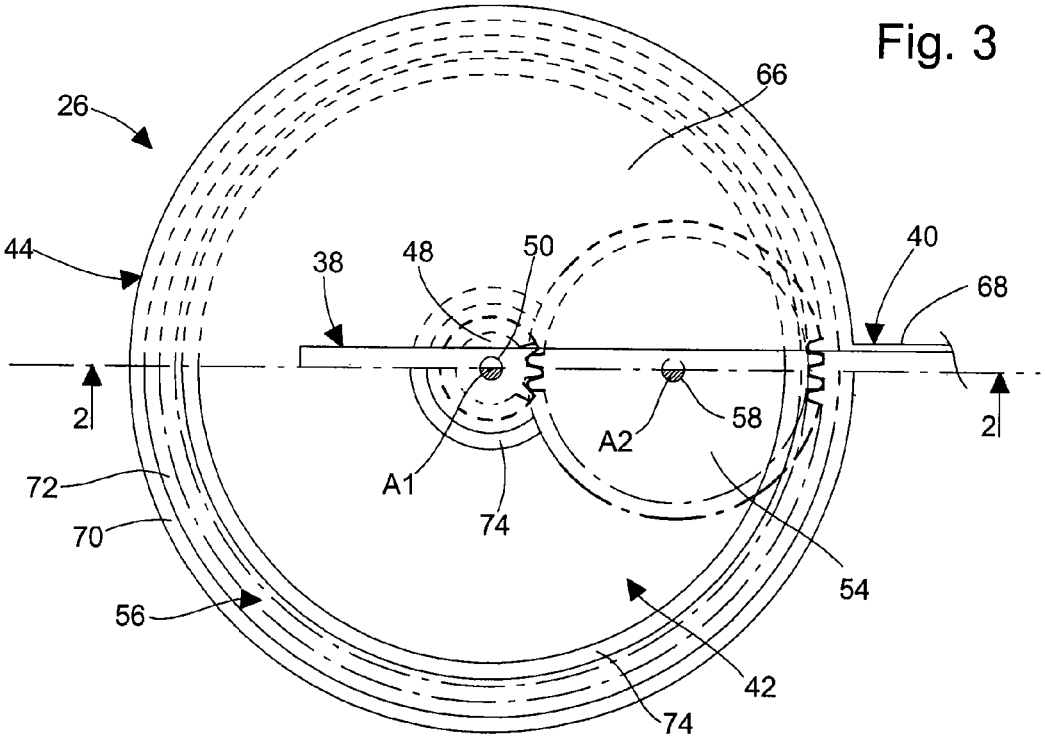
FIG. 3 is a top view including a semi transverse cross-section along the plane 3-3 which schematically shows the drive device of FIG. 2.

FIGS. 1 to 3 shows an electronic timepiece 10 made in accordance with a first embodiment according to the teaching of the invention. Timepiece 10 is formed here by a watch 10 which includes a case 12, for example of cylindrical shape.

In the following description, a vertical orientation along the main axis A1 of case 12 will be used in a non limited manner.

Case 12 is formed by a bottom wall 14 extending generally in a transverse plane, by a peripheral axial wall 16, and by a top protective glass 18 which closes case 12 on the side of the top display face 20 of watch 10.

Case 12 contains an electronic control circuit 22 which is arranged here on a printed circuit board 24 and which drives an analogue display device 26. The control circuit 22 includes electronic components, such as a control unit 28 and a time base circuit formed by a reference oscillator 30, connected to each other by electrically conductive paths 32 carried by printed circuit board 24. The control unit 28 can be formed, for example, by a microcontroller or by logic circuits. Case 12 also contains an electric power source, formed here by a battery 34.

The printed circuit board 24 and battery 24 are arranged under a display dial 36 which is fixed in case 12.

Of course, external control means (not shown) such as push buttons or a crown can be provided to allow a user to operate display device 26 and for example two reset the time of watch 10.

Display device 26 includes a first analogue display member 38 displaying a first piece of information and a second analogue display member 40 displaying a second piece of information. According to the embodiment shown, the first 38 and the second 40 analogue display members are respectively formed by a minute hand 38 and an hour hand 40 which are rotatably mounted in relation to a plate 42 about the main axis A1. Of course, the two hands 38, 40 each extend into a plane located above dial 36.

It should be noted that the value of the second piece of information is linked to the value of the first piece of information in a reduction ratio of 1:2, minute hand 38 completing twelve revolutions about its main axis A1 when minute hand 40 completes one revolution.

The two hands 38, 40 are driven in rotation by a drive device 44 with planetary gears which is carried by plate 42.

Drive device 44 includes a motor element 46 driving in rotation a central pinion 48 which is secured in rotation to minute hand 38. Central pinion 48 and minute hand 38 are fixed here to a drive arbour 50, which forms the output arbour of motor element 46.

Preferably, motor element 46 is arranged underneath plate 42, here in the form of a disc centred on main axis A1, and drive arbour 50 extends axially upwards, through a hole 52 arranged in plate 42. Motor element 46 includes, for example, a clockwork type electric motor, called a Lavet motor, which drives drive arbour 50 directly or via a reduction gear train. Motor element 46 can be carried by plate 42 or by printed circuit board 24, and it is electrically connected to control circuit 22 and to battery 34.

A planet pinion 54 meshes with central pinion 48 and with a fixed crown 58 with an inner toothing, centred on main axis A1, such that, seen from the top view of FIG. 3, the clockwise rotation of central pinion 48 causes, on the one hand, the rotation of planet pinion 54 anti-clockwise about its axis A2 and, on the other hand, the movement of planet pinion 54 along a circular trajectory centred on main axis A1 and oriented in the clockwise direction.

Hour hand 40 is mounted to rotate freely on drive arbour 50 and is driven in rotation about main axis A1 by the movement of axis A2 of planet pinion 54.

The sizing of the elements of the planetary gear formed by crown 56, central pinion 48 and planet pinion 54 is determined such that the reduction ratio between the rotation of axis A2 of planet pinion 54 about main axis A1 and central pinion 48, is equal to 1:12, i.e. equal to the reduction ratio linking the hour value to the minute value.

By calculating the equation of the planetary gear, it can be determined that the radius R2 of the circular trajectory defined by axis A2 of planet pinion 54 must be equal to six times the radius R1 of central pinion 48, and that the inner radius R3 of crown 56 must be equal to eleven times the radius R1 of central pinion 48.

According to an example embodiment, central pinion 48 can be made with a radius R1 equal to 0.4 mm, which means a radius R3 equal to 4.4 mm for crown 56. Thus, it is possible to obtain a drive device 44 whose external diameter, defined by the external diameter of crown 56, is of the order of 10 mm.

Advantageously, crown 56, central pinion 48 and planet pinion 54 extend generally in the same radial plane, which minimises the axial space requirement of drive device 44.

According to another advantageous feature, crown 56 is made in a single piece with plate 42. Crown 56 thus forms a dome with plate 42 inside which central pinion 48 and planet pinion 54 are housed, with the top face 57 of plate 42 forming the bottom of the dome.

In accordance with the teaching of the invention, hour hand 40 is pivoted on axis A1 of planet pinion 54. Thus, hour hand 40 carries here a pivot 58 which extends axially downwards, from its bottom face 60, and which is received in a complementary bore 62 arranged in planet pinion 54. Preferably, pivot 58 is made in a single piece with hour hand 40, but it could also be driven into hour hand 40 or welded thereto.

According to a variant of the invention, pivot 58 is carried by planet pinion 54 and bore 62 is arranged in hour hand 40.

Advantageously, a spacer element 64 is inserted between minute hand 38 and hour hand 40. It is formed here by a tubular section 64 integral with minute hand 38, and its external diameter is less than the external diameter of central pinion 48. Since minute hand 38 is driven onto drive arbour 50, spacer 64 holds hour hand 40 axially on the opposite side of plate 42 while minimising friction between minute hand 38 and hour hand 40.

According to an advantageous embodiment, hour hand 40 covers the whole of the circular area delimited by crown 56, so as to form a cover above plate 42 that protects the gears of drive device 44. Thus, hour hand 40 includes here a main portion in the shape of a disc, centred on main axis A1, and an indicator portion 68 of rectangular shape, which extends radially beyond the external diameter of main portion 66 to indicate the value of the hours on dial 36. The disc-shaped main portion 66 could also be added to hour hand 40.

According to the embodiment shown, pivot 58 of hour hand 40 is arranged between main axis A1 and the indicator portion 68. According to a variant (not shown), pivot 58 of hour hand 40 could be arranged on the opposite side to indicator portion 68, in relation to main axis A1, which may improve the equilibrium of hour hand 40 by creating an unbalance.

Preferably, the main portion 66 of hour hand 40 rests on a circular slide path 70 arranged on the top annular radial surface 72 of crown 56, which minimises any friction of hour hand 40 on crown 56.

Similarly, it is possible to arranged circular slide paths 74 on the top face 57 of plate 42 in order to minimise friction on the one hand, between central pinion 48 and plate 42 and, on the other hand, between planet pinion 54 and plate 42, if these elements are in contact with each other.

Slide paths 70, 74 are preferably made in a single piece with plate 42.

According to the first embodiment, plate 42 is added to dial 36 and fixed onto the top display surface 76 of dial 36. For this purpose, a staged axial hole 77, which receives the bottom section of plate 42 in a complementary manner, passes through dial 36. It should be noted that the bottom face 78 of plate 42 includes a housing 80 here, provided for receiving motor element 46 in a complementary manner.

The operation of display device 26 according to the invention is as follows.

Motor element 46, controlled by the electronic circuit 22 of watch 10, drives drive arbour 50 in rotation clockwise, which causes the rotation of minute hand 38 and central pinion 48 clockwise at the speed of one revolution per hour. The rotation of central pinion 48 causes planet pinion 54 to move about main axis A1, which drives hour hand 40 clockwise at the speed of one twelfth of a revolution per hour.

We will now describe an example method of manufacturing display device 26 according to the invention.

The method comprises a micro-machining step during which crown 56 and slide paths 72, 74 are made in a single piece with plate 42. This micro-machining step preferably uses photo-lithographic type technology, in particular a High Aspect Ratio Micromachining (HARM) technique such as LIGA (Lithographie Galvanoformung Abformung) which is described in EP Patent No. 0 851 295. LIGA technology uses a substrate to which the following treatments are applied: lithography, electrolyte bath electroplating, and moulding. This technology can be used to make plate 42 by electroforming (galvanic growth), in a metallic material, or by casting, in various materials such as metals, alloys, plastics, ceramics.

Central pinion 48 and planet pinion 54 can be made using the same manufacturing technology as plate 42. Preferably, they are made by machining or stamping, in a material known to suit horological applications, for example brass.

Preferably, hands 38, 40 are made using the same manufacturing technology as plate 42, which allows spacer 64 and pivot 58 to be made in a single piece with their respective hands 38, 40.

According to alternative embodiments, hands 38, 40 can be made by machining or stamping a material such as iron or brass, by moulding a thermohardening synthetic material, or by micromachining a substrate made of monocrystalline material such as silicon by a photo-lithographic type method.

The manufacturing method for the display device 26 according to the invention further comprises an assembly step including the following steps.

Motor element 46 is mounted in housing 80 located underneath plate 42, such that its drive arbour 50 extends through hole 52.

Central pinion 48 is driven onto drive arbour 50 and planet pinion 54 is mounted on plate 42 between the teeth of central pinion 48 and the teeth of crown 56.

Hour hand 40 is threaded onto drive arbour 50 to be free in rotation about main axis A1. Hour hand 40 is then assembled on planet pinion 54 by pivot 58 which is received in bore 62.

Minute hand 38 is then driven onto drive arbour 50 coming into contact with hour hand 40 via its spacer 64, such that hour hand 40 is held axially between the top radial face 72 of crown 56 and spacer 64.

The manufacturing method according to the invention thus allows a display device 26 to be obtained in the form of a module that can easily be added to an apparatus for receiving it, in particular to watch 10 according to the invention.

Figure 4:
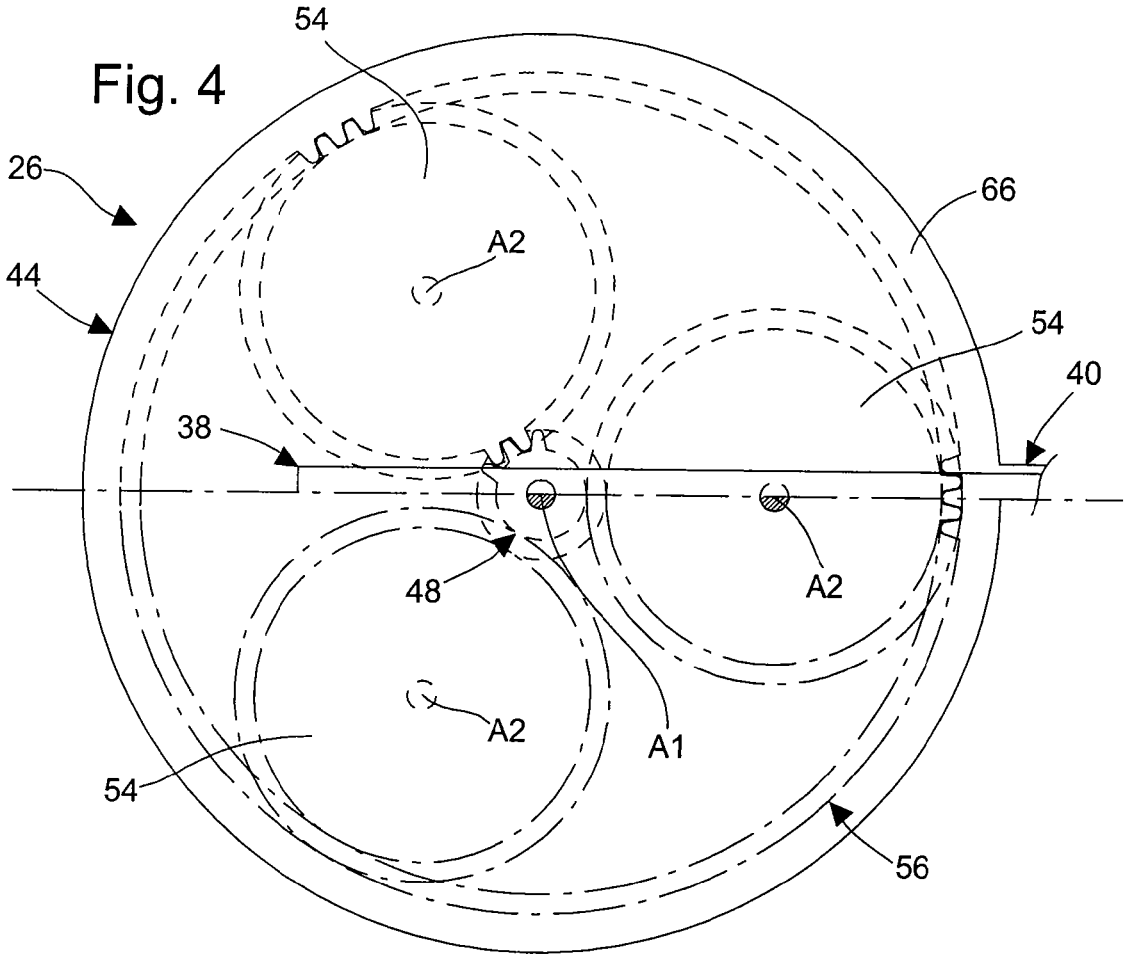
FIG. 4 is a view similar to FIG. 3 which shows the drive device of a display device made according a second embodiment of the invention.

According to a second embodiment of display device 26 according to the invention, which is shown in FIG. 4, drive device 44 includes three planet pinions 54. Hour hand 40 is preferably pivoted on the axes of rotation A2 of the three planet pinions 54, which improves its stability and its rigidity. The manufacturing, assembly and operation principle of display device 26 according to the first embodiment of the invention remains unchanged.

Of course, drive device 44 could also include two planet pinions 54 instead of three.

Figure 5:
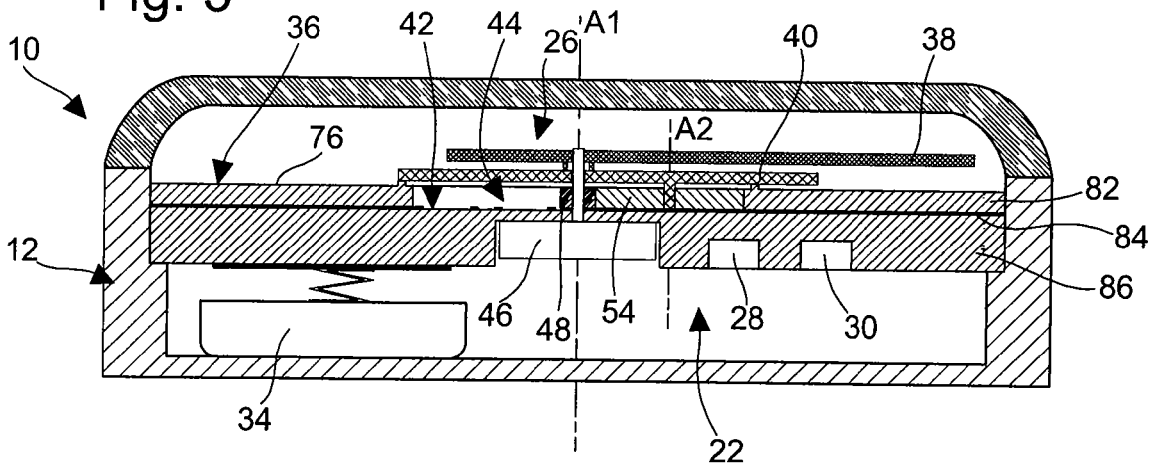
FIG. 5 is a similar view to that of FIG. 1 which shows a watch fitted with a display device according to a third embodiment of the invention.

According to a third embodiment of watch 10 according to the invention, which is shown in FIG. 5, plate 42 is made in a single piece with dial 36. More specifically, plate 42 and crown 56 are etched in the top face 76 of dial 36.

Preferably, this third embodiment is implemented with a dial 36 made of a silicon-based monocrystalline material, which allows the electronic components 28, 30 to be made in the form of integrated circuits directly etched in a layer of silicon forming dial 36. These components are arranged here in the bottom face of dial 36 but they could also be arranged in its top face 76. This third embodiment thus allows the printed circuit board and its drawbacks to be omitted.

Advantageously, dial 36 can include several identical control units 28 etched in its bottom face. Thus, if one control unit 28 is defective, control circuit 22 can simply be connected to another control unit 28 that is fit to operate.

Dial 36 can also include several control units 28 of different types, which allows the same dial 36 to be used for different types of watch 10. Thus, during the assembly of watch 10, the control circuit 22 can simply be connected to the control unit 28 suited to the type of watch being assembled.

It should be noted that motor element 46 could be made in the form of a micro electromechanical system (MEMS) by micromachining dial 36 in accordance with a photolithographic type method. This type of motor element 46 is described and shown, for example in WO Patent No. 2004/081695, incorporated herein by reference. In this patent, motor element 46 is made by etching a silicon layer. It comprises a toothed drive wheel and actuating fingers that cooperate with the teeth of the wheel to cause it to rotate. Each actuating finger is secured in movement to a mobile comb which moves in relation to a fixed comb as a function of a voltage applied to the fixed comb.

It will be noted that, relative to the first embodiment of the invention, the method for manufacturing display device 26 comprises a slightly different micromachining step for plate 42 since plate 42 is manufactured with dial 36.

The manufacturing technology implemented here is photolithographic type micromachining in a silicon substrate. An S.I.O. (Silicon-on-insulator) manufacturing technique is preferably used here, like that described with reference to FIGS. 7A to 7D in the aforementioned patent. By implementing the S.I.O manufacturing technique, one obtains a dial 36 whose main body includes, here from top to bottom, a top silicon layer 82 forming the substrate for example 350 micrometers thick, an intermediate insulating silicon oxide layer ($SiO_2$) 84 and a bottom silicon layer, for example from 200 to 300 micrometers thick. Control unit 28 and oscillator 30 are formed in bottom layer 86. Conductive paths are also formed in bottom layer 86 to connect the components to each other electrically.

Advantageously, planet pinion 54 is made in the silicon substrate, during manufacture of dial 36 and plate 42 by micromachining.

Oscillator 30 can be made in accordance with the teaching of WO Patent No. 2001/33711, incorporated herein by reference, which describes and shows a silicon oscillator to be made on the same substrate as the integrated circuit forming control unit 28 of watch 10. Oscillator 30 thus has the shape of a micro- or nano-electromechanical structure which is etched in the main body of dial 36 and which is electrically connected to control circuit 22.

This third embodiment has the advantage of being particularly compact in thickness. The manufacture of control circuit 22 is facilitated since there is no longer a step of assembling/mounting the electronic components, since the latter are etched directly in dial 36. The etching techniques used in microelectronics allow a large number of components to be made simultaneously (batch processing), which minimises manufacturing costs.

Of course, other variants, not shown here, could be envisaged without departing from the scope of the invention.

In particular, plate 42 could be arranged in an aperture made in dial 36 and be fixed to an element arranged underneath dial 36, for example on printed circuit board 24 or on a plate of a mechanical movement, for a mechanical watch. Display device 26 can also be fixed directly or indirectly to case 12.

It should be noted that watch 10 could include a plate extending radially between crown 56 and hour hand 40, for example to play the part of a protective cover for drive device 44. In such case, said plate would have to comprise a circumferential groove allowing pivot 58 to pass.

Although the invention has been described with reference to an electronic watch 10, the invention also applies to a mechanical watch wherein the motor element 46 is formed by a spring cooperating with a mechanical escapement system and regulator.

Hands 38, 40 could also be replaced by rotating display discs.

The invention has been described with reference to a display device 26 displaying time information, the first piece of information being the minutes and the second piece of information being the hours. However, the invention also applies to a display device 26 displaying another type of information such as altitude. In such case, the first piece of information can be the hundreds of meters of altitude and the second piece of information can be the thousands of meters of altitude. The reduction ratio is then equal to 1:10, which requires drive device 44 to be sized differently.

The invention claimed is:

1. A timepiece including a display dial and a display device, which includes a first rotating analogue display member displaying a first piece of information and a second rotating analogue display member displaying a second piece of information, the value of the second piece of information being linked to the value of the first piece of information in a determined reduction ratio, wherein the first and the second display members are rotatably mounted in relation to a plate about the same main axis and are driven in rotation by a drive device with planetary gears carried by the plate, and wherein the drive device includes a motor element provided for driving in rotation a central pinion which is secured in rotation to the first display member, and at least one planet pinion, which meshes with the central pinion and with a crown with an inner toothing, the second display member being driven in rotation about the main axis by the movement of the axis of the planet pinion, wherein the second display member extends in a plane located above the display dial, and wherein the second display member pivots on the axis of rotation of the planet pinion.

2. The timepiece according to claim 1, wherein the drive device includes a drive arbour, coaxial to the main axis, which is driven in rotation by the motor element, and in that the central pinion and the first display member are secured to the central arbour.

3. The timepiece according to claim 2, wherein the motor element includes an electric motor and an output arbour which forms the drive arbour of the drive device.

4. The timepiece according to claim 1, wherein the second display member carries a pivot and wherein the planet pinion is rotatably mounted about said pivot.

5. The timepiece according to claim 1, wherein the drive device includes three planet pinions and wherein the second display member pivots on the axes of rotation of the three planet pinions.

6. The timepiece according to claim 1, wherein the second display member is held axially on the opposite side to the plate by the first display member.

7. The timepiece according to claim 6, wherein a spacer element is inserted between the first and the second display members.

8. The timepiece according to claim 1, wherein the second display member covers the entire circular area delimited by the crown.

9. The timepiece according to the claim 8, wherein the crown includes an end surface provided with a circular slide path, and wherein the second display member rests on said slide path.

10. The timepiece according to claim 1, wherein the crown, the central pinion and the planet pinion extend generally in the same radial plane.

11. The timepiece according to claim 1, wherein the plate is arranged on the side of the display face of the dial.

12. The timepiece according to claim 11, wherein the plate is added to the display face of the dial.

13. The timepiece according to claim 11, wherein the plate is made in a single piece with the dial.

14. The timepiece according to claim 1, wherein the plate is made of a monocrystalline material.

15. The timepiece according to claim 1, provided with a display dial which includes a main body made of semiconductor material, wherein the motor element is driven by an electronic control circuit, wherein the electronic control circuit includes at least one integrated circuit element which is etched in the main body of the dial.

16. The timepiece according to claim 15, wherein the motor element is a micro electromechanical system which is etched in the main body of the dial.

17. The timepiece according to claim 1, wherein the drive device includes slide elements which are inserted between one face of the plate and the pinions in order to decrease their resistance to friction during rotation.

18. The timepiece according to claim 17, wherein the slide elements are formed by circular slide paths arranged on the plate.

19. The timepiece according to claim 18, wherein the slide paths are made in a single piece with the plate.

20. The timepiece according to claim 19, wherein the display members are hands.

21. The timepiece according to claim 1, wherein the crown is made in a single piece with the plate and wherein the plate is carried by the dial.

22. The timepiece according to claim 21, wherein the first display member is formed by a minute hand and the second display member is formed by an hour hand.

23. A method of manufacturing a timepiece including a display dial and a display device, a first rotating analogue display member displaying a first piece of information and a second rotating analogue display member displaying a second piece of information, the value of the second piece of information being linked to the value of the first piece of information in a determined reduction ratio, wherein the first and the second display members are rotatably mounted in relation to a plate about the same main axis and are driven in rotation by a drive device with planetary gears carried by the plate, and wherein the drive device includes a motor element provided for driving in rotation a central pinion which is secured in rotation to the first display member, and at least one planet pinion, which meshes with the central pinion and with a crown with an inner toothing, the second display member being driven in rotation about the main axis by the movement of the axis of the planet pinion, wherein it includes an assembly step during which the second display member is mounted to rotate freely on the main axis and during which the second display member is assembled to the planet pinion by a pivot and wherein a micromachining step including a photolithographic treatment is implemented in order to obtain the plate.

24. The manufacturing method according to claim 23, characterized in that the crown is made in a single piece with the plate and obtained by said micro machining step.

25. The manufacturing method according to claim 23, wherein the planet pinion is obtained by the micromachining step.

26. The manufacturing method according to claim 23, wherein the plate is made in a single piece with the display dial during the micromachining step.

27. The manufacturing method according to claim 24, wherein the planet pinion is obtained by the micromachining step.

* * * * *